US005478083A

United States Patent [19]

Foster, II

[11] Patent Number: 5,478,083

[45] Date of Patent: Dec. 26, 1995

[54] GOLF PUTTING TRAINING DEVICE

[75] Inventor: Howard C. Foster, II, Edwards, Colo.

[73] Assignee: Howard C. Foster, Edwards, Colo.

[21] Appl. No.: 425,413

[22] Filed: Apr. 20, 1995

[51] Int. Cl.[6] ..... A63B 69/36; A63B 53/16

[52] U.S. Cl. ..... 273/194 R; 273/81.2; 273/81.3; 273/81.4

[58] Field of Search ..... 273/194 R, 194 B, 273/193 R, 81 R, 165, 81.2, 81.3, 81.4, 81 C, 81 D

[56] References Cited

U.S. PATENT DOCUMENTS

| | | | |
|---|---|---|---|
| 1,648,354 | 11/1927 | Lied | 273/165 |
| 1,855,126 | 4/1932 | Connell | 273/165 |
| 2,086,974 | 7/1937 | Belfore | 273/165 |
| 3,459,426 | 8/1969 | Sherwood | 273/81 R |
| 4,215,860 | 8/1980 | Nakamatsu | 273/81 R |
| 4,919,433 | 4/1990 | Millat | 273/192 |
| 5,064,198 | 11/1991 | Szabo | 273/189 R |
| 5,088,738 | 2/1992 | Mundt | 273/81 D X |
| 5,102,142 | 4/1992 | Bittl | 273/192 |
| 5,116,057 | 5/1992 | Mangiaracina | 273/166 X |
| 5,125,844 | 6/1992 | Grant et al. | 434/252 |
| 5,301,949 | 4/1994 | Aupied | 273/192 |

*Primary Examiner*—George J. Marlo
*Attorney, Agent, or Firm*—Duft, Graziano & Forest

[57] ABSTRACT

A golf training aid which pro-actively trains the golfer to use the upper body muscles to stroke a putt using the golfer's preferred putter. A "paddle-like" handle having substantially flat planar surfaces is attached to the top of the putter shaft. The paddle is held with the golfer's hands open and finger extended by applying inward pressure on both hands. This inward pressure helps to freeze the golfer's muscles in the hands, wrists, and forearms forcing the golfer to use the larger upper body muscles to stroke the putt. In one embodiment the paddle is secured to the grip of the putter by straps laminated with tacky elastomer material and Velcro. The closed straps press the grip against a slot in the paddle lined with elastomer material. The friction thus produced maintains the parallel alignment of the paddle with the face of the putter head. A second embodiment discloses a paddle which is split in halves with a slot formed between the halves. The slots are lined with tacky elastomer material such that when the paddle halves are mated together, the putter grip is pressed between the elastomer line slots to thereby secure the paddle to the grip and maintain the parallel alignment of the paddle with the face of the putter head.

8 Claims, 10 Drawing Sheets

FIG. 5A
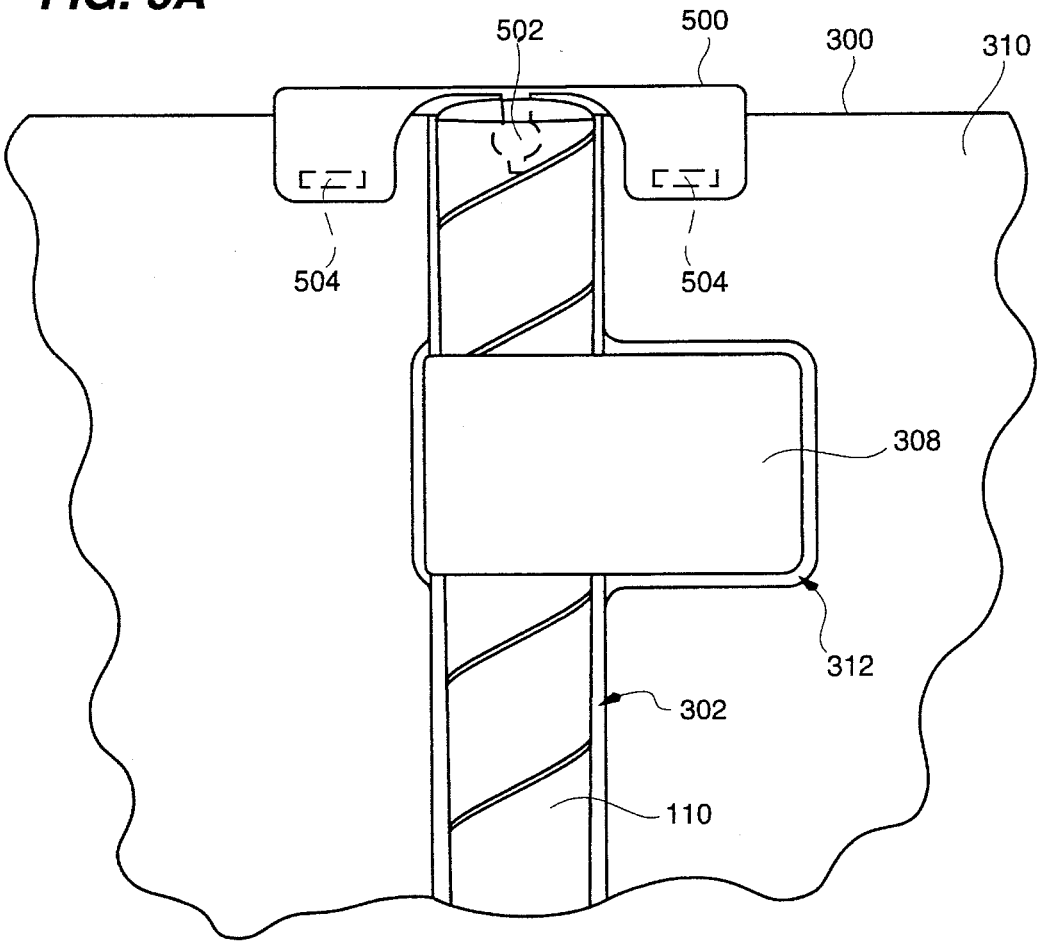
FIG. 5B
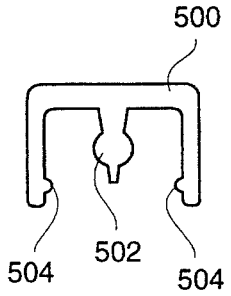
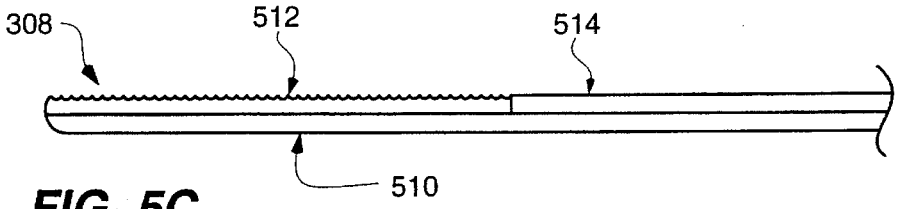
FIG. 5C

GOLF PUTTING TRAINING DEVICE

BACKGROUND OF THE INVENTION

1. Field of the Invention

The present invention relates to golf clubs and in particular to a handle which attaches to the standard grip of a golf putter to train the golfer's muscles in the preferred method of putting a golf ball.

2. Description of Related Art

A consistent, repeatable, smooth, and straight motion of a putter is required to accurately putt a golf ball on the green in the game of golf. This seemingly simple physical act has frustrated golfers since the advent of the game. Amateurs and professionals alike seek to train themselves to apply such a smooth, repeatable motion to the putter. It is well established that the preferred approach to an accurate putting stroke is to utilize the larger muscles in the upper body to stroke the putter. It is a common error in golf that the golfer tends to use smaller muscles in the forearms, hands, or wrists in the putting stroke. These smaller muscles provide less overall power than the larger upper body muscles and therefore may tend to provide a less repeatable, "jerky" motion in the putting stroke. Golfers sometimes refer to this as the "yips." The smaller muscles in the hands, wrists, and forearms may also contribute unevenly to the putting stroke thereby forcing the golf ball off target as one arm or the other exerts more or less force in the putting stroke.

Several prior approaches have attempted to aid or train the golfer to improve the putting stroke One type of putting aid is a frame or track structure which attempts to guide the path of the putter or the path of the golfer's arm and body motion to improve the putting stroke. U.S. Pat. No. 4,919,433 (issued Apr. 24, 1990 to Millat) and U.S. Pat. No. 5,102,142 (issued Apr. 7, 1992 to Bittl) are exemplary of golf training devices which attempt to guide the path of motion. Millat discloses a training aid comprising a frame structure which guides the path of the putter and attempts to force the golfer to use the forearms, hands, and wrists. Bittl teaches a larger frame structure which forces the golfers body into a repeatable position and attempts to guide the path of the arms in the putting stroke. Both of these devices are passive in the sense that they merely guide the path of the stroke to encourage the golfer's muscles to learn a repeatable stroke. In addition, neither of these training devices may legally be used on the golf course during play according to the rules of golf. Finally, Millat specifically teaches that the preferred muscles to guide the putting stroke are the wrist and forearm muscles rather than well established current methods which prefer the; use of the large upper body muscles in the shoulders.

A second type of training aid recognizes the preference that the wrists remain steady during the putting stroke and attempt to lock the wrists of the golfer. U.S. Pat. No. 5,064,198 (issued Nov. 12, 1991 to Szabo) and U.S. Pat. No. 5,116,047 (issued May 26, 1992 to Mangiaracina) are exemplary of golf training devices which attempt to lock the wrists during the putting stroke. Szabo teaches a strap that wraps around the wrist of the trailing arm (the rearward arm) in the putting stroke and around the middle finger of the corresponding hand. This device claims to lock the wrists to encourage the golfer to use the upper body muscles to stroke the putter (although it is unclear how the strap can succeed in locking the wrists from movement in more than one direction —movement in the opposite direction is apparently not prevented by the strap). Mangiaracina discloses a wrist strap placed on the leading wrist (the forward wrist in the putting stroke) and a mated strap placed around the top of the putter grip adjacent the wrist strap. The two straps are connected with Velcro so as to provide physical resistant, to motion of the wrist and to provide an audible sound when the wrist strap and mated grip strap separate (from undesirable motion of the wrist). As above, these devices are passive in that they attempt to resist the undesirable motion of the wrist as opposed to pro-actively forcing the use of the proper muscles in the upper body.

Another type of golf putting aid is disclosed in U.S. Pat. No. 3,459,426 (issued Aug. 5, 1969 to Sherwood). Sherwood teaches a grip affixed to the shaft of the putter which is substantially flat and planar as opposed to the more traditional rounded grip. The flat planar grip is held between the golfer's hands with palms and fingers open and spread. Sherwood refers to the hands as being in a prayer-like position. Sherwood teaches that in this position, the putter is stroked using only the golfer's wrists in a manner similar to a croquet mallet: the golfer, facing the hole, pivots the wrists to draw the club back between the legs and then pivots the wrists forward to move the club forward and through the ball toward the hole. The putter face is substantially perpendicular to the flat planar grip when stroked in this manner. Sherwood's method and putter is contrary to the accepted norm that the upper body muscles are preferred in stroking a putt and its use is contrary to the rules of golf. Specifically, a golfer is not permitted to stand astride the intended line of a putt when putting the ball on the green under the rules of the game. In addition, Sherwood's device is in itself a putter, not a device to be used with the putter preferred by the golfer,. The putter is a club which is used most by "feel." The golfer develops a feel of the particular weight and balance of his or her own personal putter. Changing putters, as Sherwood's invention would require, is not done lightly in the game of golf!

It is apparent from the above discussion that there is a need for an improved golf training device which pro-actively teaches the use of the upper body muscles in putting a golf ball, is usable with the golfer's normal putter, and is simultaneously usable in a manner which would teach the golfer a legal putting stroke useful on a golf course when playing the game of golf.

SUMMARY OF THE INVENTION

The present invention solves the above-identified problems and thereby advances the art by providing a putter grip which is removably attached to the golfer's putter, is usable in a manner which teaches a legal putting stroke in playing a game of golf, and pro-actively teaches the golfer to use the upper body muscles in stroking the putter.

The present invention comprises a substantially flat planar grip (also referred to herein as a "paddle") which is easily attached to, or detached from, the grip of a standard putter. The plane of the paddle is substantially aligned with the plane of the face of the putter head so that the golfer uses the grip in conjunction with a standard, legal putting stance and stroke, namely standing parallel to the initial direction of travel of the ball to the hole. The paddle is attached to the putter grip by placing the putter grip in a centered slot in the paddle. The slot is lined with an elastomer material to help prevent slippage between the paddle and the putter grip. The elastomer is any commonly available, highly compressible elastomer having a high coefficient of friction and tackiness. Examples of such materials are: neoprene, nitrile rubber, butyl rubber, polysulfide rubber (also known as "Thiokol"), silicone rubber, and polyurethane rubber. Foams manufactured of these materials are preferred for their lighter weight. As used herein, these materials will be referred to as "foam rubber."

In one embodiment the paddle is secured to the grip with straps. The straps are laminated with a foam rubber layer over the strap where the strap contacts the grip and laminated with a Velcro layer at the end of the strap where the strap is secured to mating Velcro affixed to the paddle. A tacky cover material is placed over the paddle, and also secured by Velcro to cover the straps, the putter grip, and the center slot of the paddle. The tacky cover provides a secure grip for the golfer's hands against the planar surfaces of the paddle.

In an alternative embodiment, the paddle itself is split through its center plane such that approximately half of the slot is formed in each half of the paddle. As above, the slot is lined with foam rubber to help prevent slippage between the paddle slot and the putter grip. The two halves of the paddle are separated to insert the putter grip into the center slot of the paddle. The foam rubber liner of the slot is compressed against the grip by mating the two halves of the paddle. Mated male and female guides assure that the two halves are accurately mated. Velcro straps are then used to secure the two halves together in the mated position to thereby secure the paddle to the grip. The paddle halves are made of flexible material and spring metal is enclosed within each half of the paddle. The spring metal is normally biased to arc the paddle halves outward, away from one another at two ends. When the two spring biased halves are secured to one another, the spring metal applies pressure to secure the putter grip within the foam rubber lined slot of the paddle. A tacky cover is affixed to the outer surface of each half of the paddle to provide a secure grip for the golfer's hands against the planar surfaces of the paddle.

The paddle is held with palms and fingers open and held flat against the paddle with one hand on each side of the paddle. The hands are positioned vertically juxtaposed to one another as the golfer would on a normal putter grip. For example, a right handed golfer's normal putting grip would position the left hand (leading hand) somewhat higher than the right hand (trailing hand). A right handed, cross-handed putting golfer would reverse this position and place the left hand somewhat lower than the right. A left handed golfer would simply reverse the above positions. Holding the paddle in this position, with both hands open and fingers extended, pro-actively encourages the golfer to stroke the putt using the upper body muscles. The golfer must apply inward pressure on both hands to maintain his hold on the paddle handle because the fingers cannot hold the flat planar surfaces. In this position, the hands, wrists, and forearms are naturally locked or frozen due to the inward pressure applied from the arms. The golfer will more naturally use the upper body muscles to stroke the putt when the forearms, hands, and wrists are locked or frozen due to the open handed "grip" of the paddle. Repetitive use of the paddle in conjunction with the golfer's preferred putter helps pro-actively train the golfer to freeze the muscles in the hands, wrists, and forearms by pressing the arms inward against the putter.

The paddle of the present invention may also be applied to elongated shaft putters designed for upright stance with widely separated hands gripping the putter. Elongated shaft putters are held with the leading hand (the hand closer the target of the putt) on the top of the putter in a stationary position. The leading hand serves as a stationary pivot point as the trailing hand, grasping the putter at approximately the midpoint of the shaft, strokes the elongated shaft backward then forward, striking the ball toward the putting target. The paddle grip of the present invention may be attached to the elongated shaft at the lower grip point where the trailing hand strokes the putter. The paddle is adapted in this alternate embodiment to provide finger holes for fingers of the trailing hand to grasp the paddle. The finger holes enable the trailing hand to draw the elongated putter back by engaging the finger holes as the trailing arm is drawn back (away from the putting target). The golfer then strokes the putt by pressing the trailing hand forward against the substantially flat planar surface of the paddle using the larger upper body muscles for improved accuracy and repeatability.

As described above, the paddle of the present invention is useful to train a golfer in proper putting stroke techniques. Unlike prior approaches, the present invention is applicable to personal variations of putting style for use in crosshanded putting or with extended shaft putters.

The present invention therefore provides a means for gripping the golfer's putter in a manner which pro-actively trains the golfer to use the large upper body muscles to produce a smooth, repeatable putting stroke. In addition, the paddle is used in a stance which is legal in a game of golf according to the rules of the game. The paddle is also attached to the golfer's preferred putter rather than requiring the golfer to become accustomed to a new putter's weight and balance. Numerous other features and advantages of the present invention will become apparent from the following description when read in conjunction with the accompanying drawings.

BRIEF DESCRIPTION OF THE DRAWINGS

FIGS. 5A, 5B, and 5C shows the same side view of FIG. 3 with additional detail of the strap and top centering clip;

DETAILED DESCRIPTION OF THE INVENTION

Overview

Figure 1:
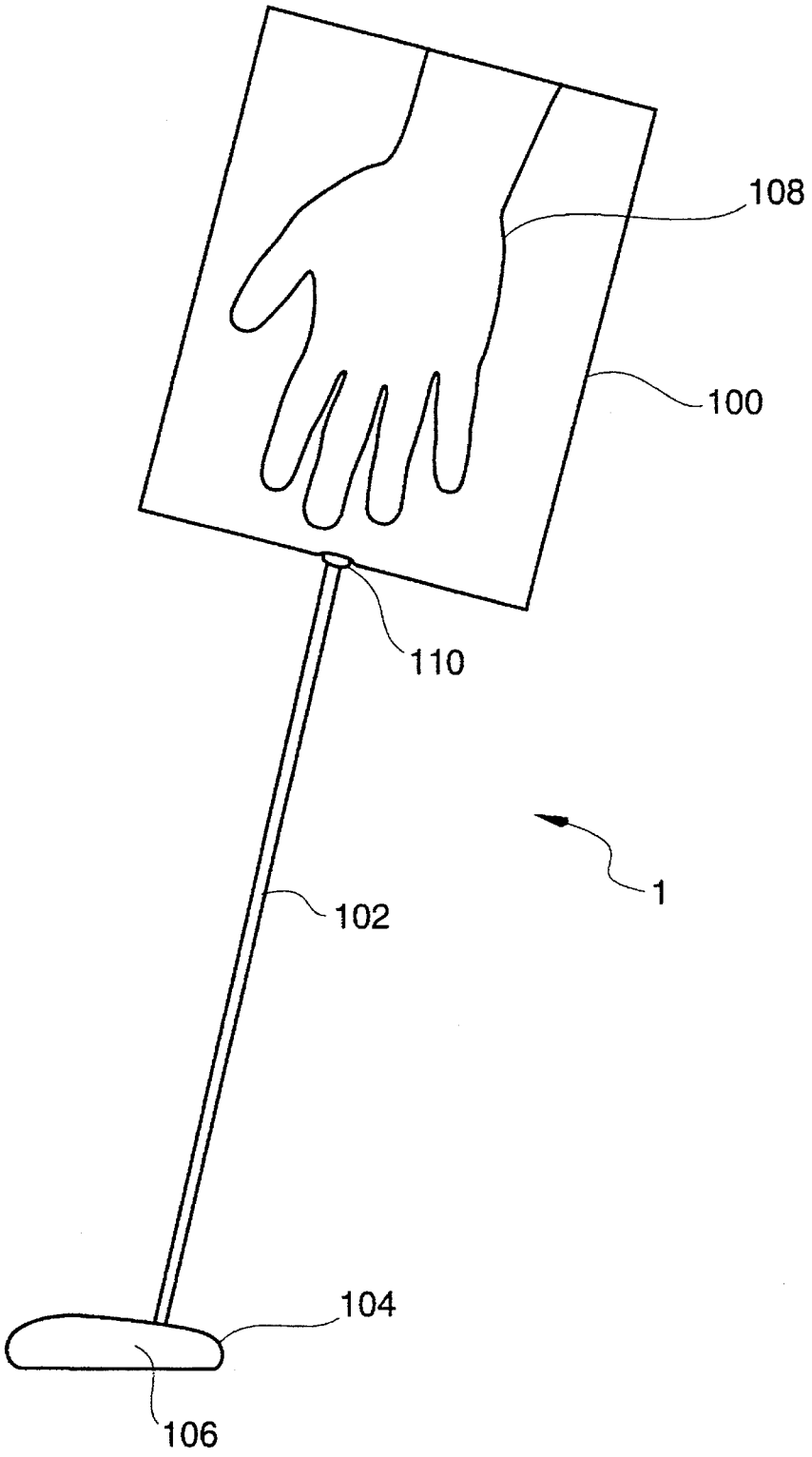
FIG. 1 shows a side view of a putter with the paddle of the present invention attached.

FIG. 1 depicts a typical putter 1 having a shaft 102 with a putter head 104 attached to the bottom of shaft 102. Paddle handle 100 (also referred to herein as "paddle" or "paddle grip") of the present invention is shown attached to the top portion of the shaft 102 of putter 1. Paddle 100 may be permanently affixed to shaft 102 by any of many well known methods such that paddle 100 is essentially integral with putter 1. Such an integral design is within the spirit and intended scope of the present invention. However, permanently affixing the paddle 100 to shaft 102 forces a golfer to use a preselected putter head 104 and shaft 102 chosen when paddle 100 is so affixed to putter 1. The preferred embodiment of the present invention therefore comprises a paddle 100 which is removably attached to putter 1. Paddle 100 is removably attachable in such a manner that a golfer may attach paddle 100 to any preferred putter 1 design. Paddle 100 may therefore be retrofit to any putter 1 preferred by the golfer and is therefore also referred to herein as a "retrofit assembly."

Paddle 100 is a substantially planar device adapted to receive grip 110 in a slot through its center. Paddle 100 is attached to grip 110 of putter 1 by various means discussed below. As shown in FIG. 1, only a bottommost portion of grip 110 is shown. The remainder of grip 110 is attached within a slot inside paddle 100 and therefore not shown in this FIG. 1. Paddle 100 is held by the golfer with both hands. One hand is placed on each side of the substantially planar flat surfaces of paddle 100. The golfer's hands are open and fingers are extended such that the paddle 100 is secured between the golfer's hands. Outline 108 depicts the open handed position of a golfer's hand against one flat planar surface of paddle 100.

Paddle 100 is gripped with the hands positioned vertically juxtaposed to one another as the golfer would on a normal putter grip. For example, a right handed golfer's normal putting grip would position the left hand (leading hand) somewhat higher than the; right hand (trailing hand). A right handed, cross-handed putting golfer would reverse this position and place the left hand somewhat lower than the right. A left handed golfer would simply reverse the above positions.

Putter head 104 has a striking face 106 viewed face-on in FIG. 1. Paddle 100 is attached to shaft 102 so that it substantially maintains parallel alignment with the plane of striking face 106. This alignment, as distinct from the Sherwood (supra.) design, permits the putter 1 with paddle 100 to be used in a putting stance and stroke which is legal according to the rules of golf. Sherwood (supra.) disclosed instead a design which aligned a similar paddle handle perpendicular to the striking face so that the putter would then be used in a manner similar to a croquet mallet, striking the ball with the golfer facing the hole astride the intended path of the putt. Such a putting stance is illegal under the rules of the game of golf. In the present invention, paddle 100 is attached to putter 1 in a plane parallel to the plane of the striking face 106 of the putter head 104. Using the paddle 100 of the present invention, the golfer stands parallel to the intended path of the golf ball and strokes the putt by drawing the putter away from the hole, then forward toward the hole striking the ball. This putting stance and stroke is legal according to the rules of the game of golf and the paddle 100 may therefore be used by a golfer for practice or for playing the game.

The golfer's grip of paddle 100 between the golfer's two hands helps to force the golfer to use the upper body muscles to stroke the putt. In order to maintain a grip on the paddle 100 with hands open and fingers extended, the golfer must press the hands together. The muscular pressure applied to force the hands together tends to freeze the golfer's muscles in the wrists, hands, and forearms to thereby reducing undesirable movement of these lower arm muscles. The golfer is then encouraged to use the larger upper body muscles to learn a smoother, more repeatable putting stroke. This improved motion is "memorized" by the golfer's muscles through repeated practice and may then be transferred to the use of the putter without the paddle 100 attached. Alternatively, as noted above, the golfer may choose to use the paddle 100 during normal play of the game of golf.

Figure 2:
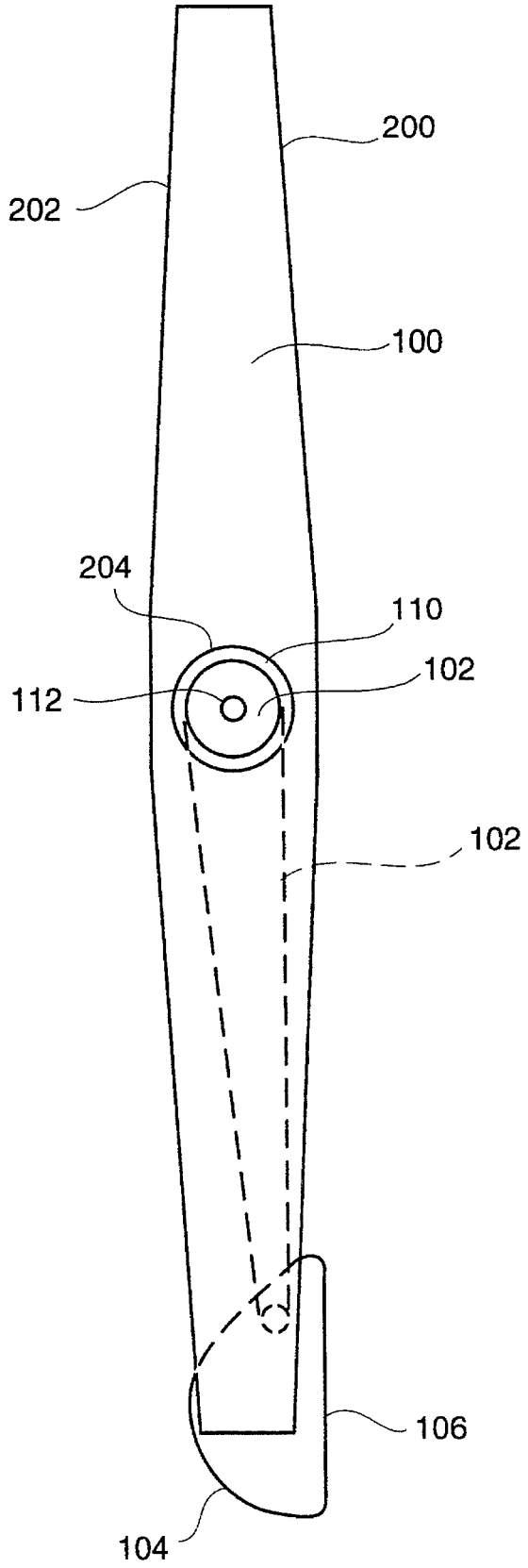
FIG. 2 shows a top view of a putter with the paddle of the present invention attached.

FIG. 2 is a top view of the paddle 100 of the present invention attached to grip 110 at the top of shaft 102 (shown by dashed line hidden by the paddle). Forward face 200 and rearward face 202 of paddle 100 are substantially flat planar surfaces. Forward face 200 is gripped by the golfer's leading hand (the hand closer the putting target). Rearward face 202 is gripped by the golfer's rearward hand (the hand further from the putting target). Slot 204 is formed in the center of paddle 100 and adapted to receive shaft 102 and grip 110. As can be seen in FIG. 2, forward face 200 and rearward face 202 are substantially parallel to striking face 106 of putter head 104. As discussed below, slot 204 and associated means for securing the grip 110 and shaft 102 in slot 204 are adapted to maintain the alignment of the paddle 100 with striking face 106.

Figure 9:
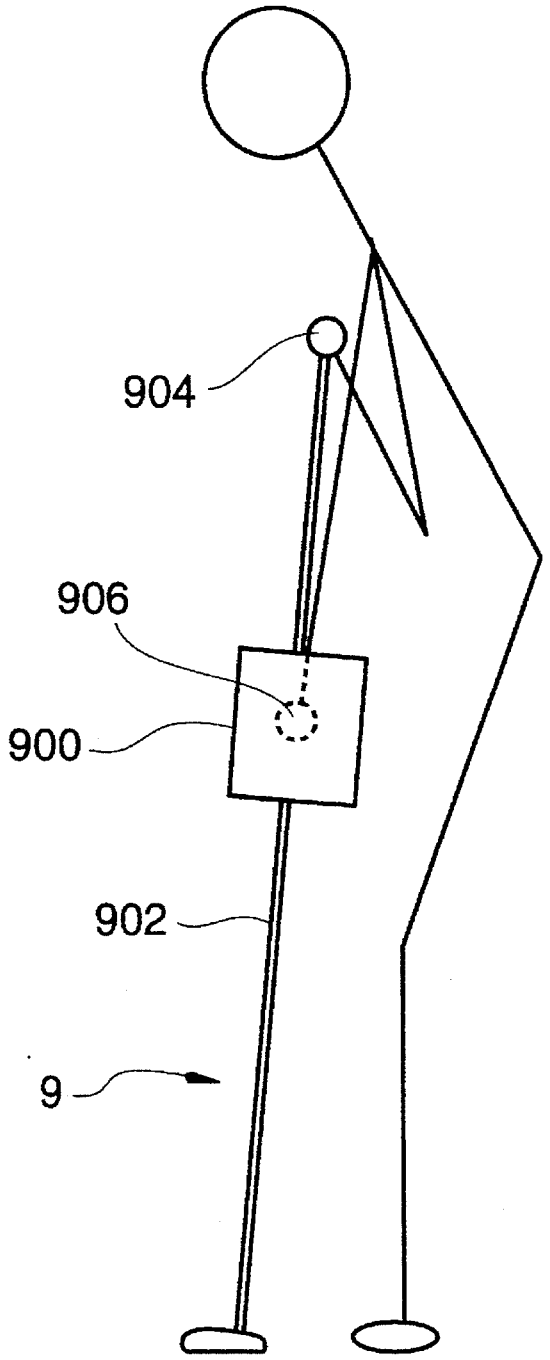
FIG. 9 depicts an alternative use of an extended shaft putter with the paddle of the present invention attached.
Figure 10:
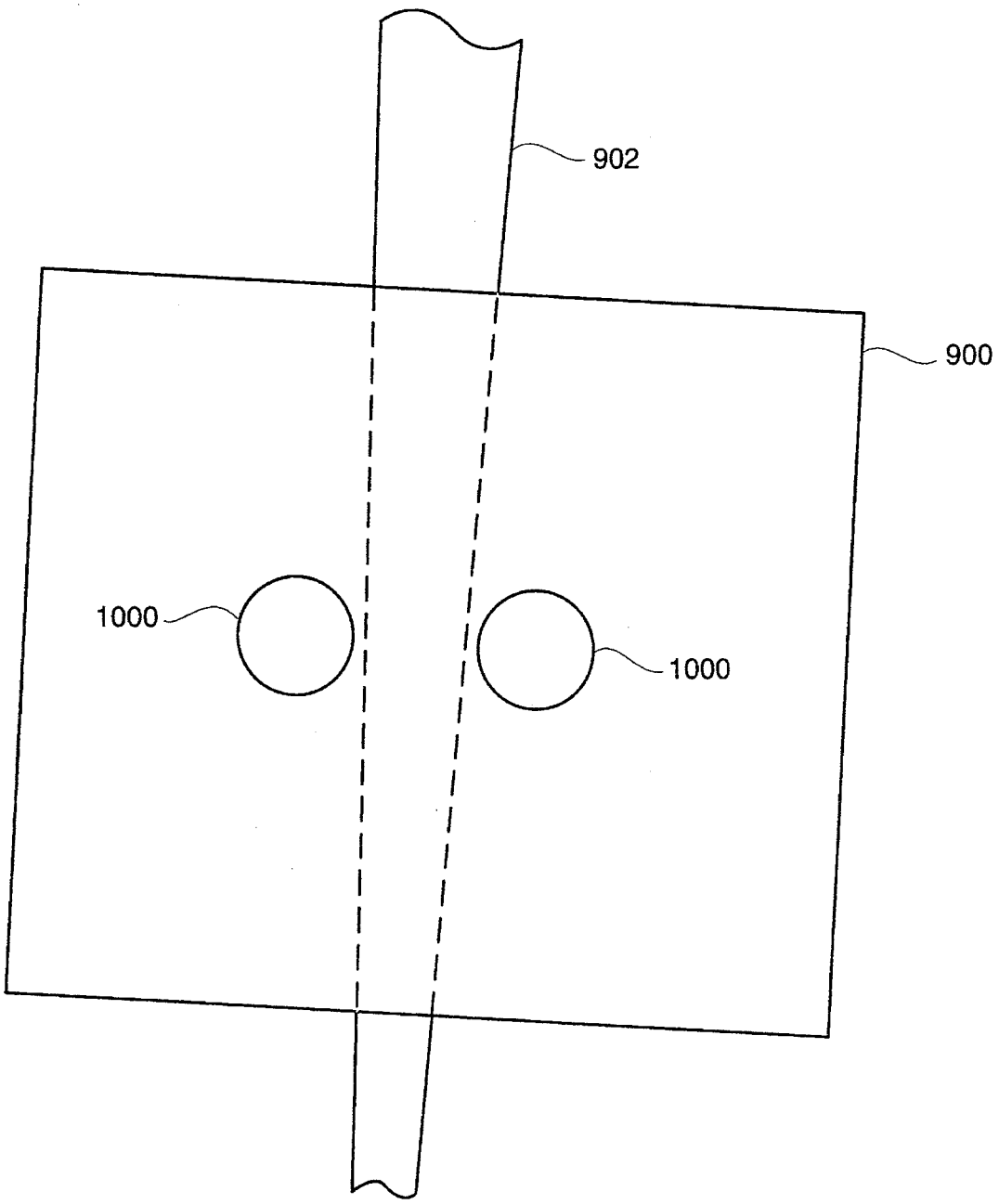
FIG. 10 shows additional detail of the paddle of the present invention adapted for use with the extended shaft putter shown in FIG. 9.

FIG. 9 shows an alternative use of paddle 900 of the present invention secured to the approximate midpoint of the shaft 902 of an extended shaft putter 9. Extended shaft putters 9 are designed for use with a more upright stance of the golfer with widely separated hands gripping the putter. Extended shaft putters 9 are held with the leading hand 904 (hand closer the target of the putt) on the top of the putter 9 in a stationary position. The leading hand 904 serves as a stationary pivot point as the trailing hand 906, grasping the extended shaft putter 9 using paddle 900 at approximately the midpoint of the shaft 902, strokes the elongated shaft 902 backward then forward, striking the ball toward the putting target. The paddle 900 grip of the present invention may be attached to the elongated shaft 902 at the lower grip point where the trailing hand 906 strokes the putter. The paddle 900 is adapted in this alternate embodiment to provide finger holes 1000 of FIG. 10 for fingers of the trailing hand 906 to grasp the paddle 900. The finger holes 1000 of FIG. 10 enable the trailing hand 906 to draw the elongated shaft putter back by engaging the finger holes 1000 as the trailing arm is drawn back (away from the putting target). The golfer then strokes the putt by pressing the trailing hand 906 forward against the substantially flat planar surface of the paddle 900 using the larger upper body muscles for improved accuracy and repeatability.

Therefore, as shown in FIGS. 1, 2, 9, and 10, paddle 100 and paddle 900 are useful to train a right handed or left handed golfer in proper putting technique using the golfer's preferred putter, whether standard or extended shaft, and using the golfer's preferred grip, whether standard or cross-handed.

Securing the paddle to the putter-straps

Figure 3:
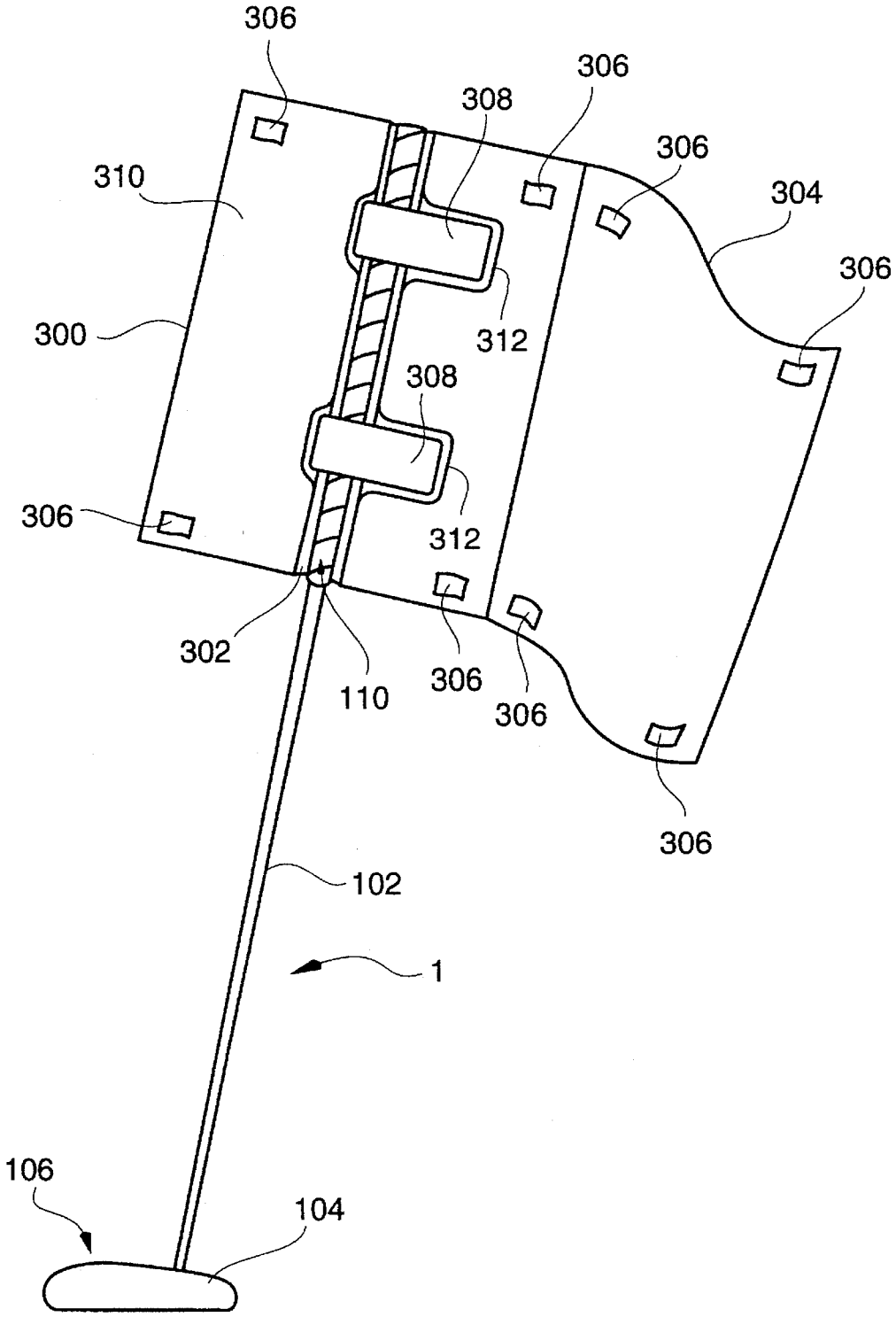
FIG. 3 shows a side view of one exemplary embodiment of the paddle of the present invention with the cover flap open.

FIG. 3 shows a first embodiment of a paddle 300 secured to putter 1 by straps 308. A cover 304 is applied to either forward face 310 of paddle 300 (or equivalently rearward face, not shown, or both forward and rearward faces). 10 Cover 304 is secured to forward face 310 by Velcro fasteners 306 applied to the mating surfaces of cover 304 and forward face 310. Slot 302 is formed in paddle 300 and adapted to receive shaft 102 and attached grip 110 of putter 1. Slot 302 is lined with a tacky elastomer material (foam rubber as discussed above). Straps 308 are attached to paddle 300 within slot 302. Grip 110 on shaft 102 is received into slot 302 when straps 308 are in an open position. Straps 308 are then closed around grip 110 to secure grip 110 and shaft 102 within slot 302. Straps 308 further serve to press grip 110 and shaft 102 against the foam rubber lining in slot 302. Recesses 312 in paddle 300 receive straps 308 when straps 308 are closed around grip 110.

Figure 4:
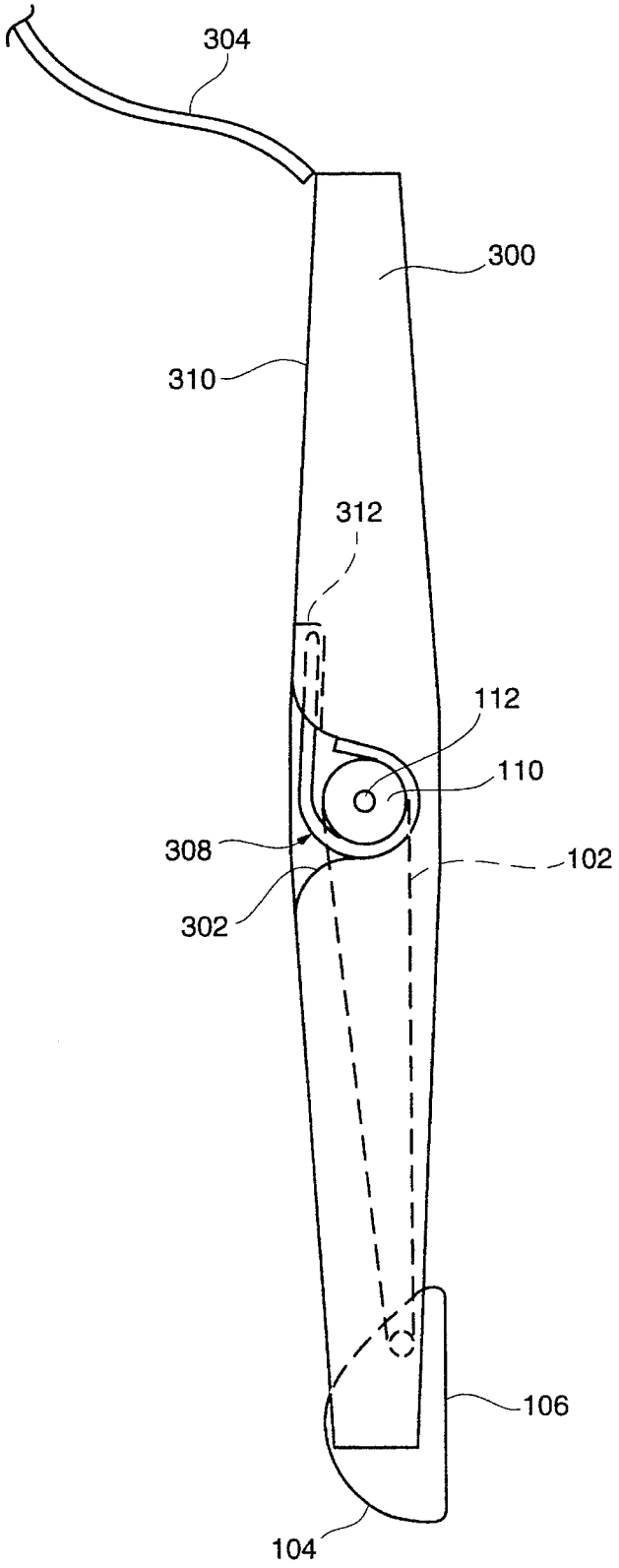
FIG. 4 shows a top view of the exemplary embodiment shown in FIG. 3.

FIG. 4 shows a top view of the embodiment of FIG. 3 to better reveal the placement and use of straps 308. Grip 110 is shown placed in slot 302 of paddle 300 and cover 304 is shown pulled back from paddle 300 rearward face 310. Straps 308 are shown in FIG. 4 closed around grip 110 within slot 302 of paddle 300. Recesses 312 are shown to receive straps 308 in the closed position to maintain a substantially fiat planar surface when cover 304 is replaced over paddle 300 forward face 310. Hole 112 in the top of grip 110 is used for grip 110 installation and removal from shaft 102. Hole 112 may also used as described below to secure and position grip 110 in slot 302 of paddle 300.

FIGS. 5A, 5B, and 5C depict additional detail of the embodiment shown in FIGS. 3 and 4. In FIG. 5A, straps 308 are shown in the closed position around grip 110 seated in slot 302 of paddle 300 forward face 310. Recesses 312 receive straps 308 in the dosed position. The structure of straps 308 are shown in additional detail in FIG. 5C. One end of woven nylon strap 510 is attached to paddle 300 in slot 302. Woven nylon strap 510 is laminated with a Velcro fastener 512 at its free end,. A foam rubber layer 51 4 is laminated to woven nylon strap 510 from the Velcro fastener 512 to the point of connection with the paddle 300. Foam rubber layer 51 4 encircles grip 110 when strap 308 is closed around grip 110. Foam rubber layer 514 in combination with the foam rubber lining in slot 302 of paddle 300 serve to secure paddle 300 to grip 110 and to maintain the desired position of paddle 300 in substantial parallel alignment with striking face 106 of FIG. 1.

Centering clip 500 is shown positioned in FIG. 5A to aid in the positioning and stabilization of putter grip 110 in slot 302 of paddle 300. Centering clip 500 is depicted end-on in FIG. 5B. Detents 504 serve to hold the U-shaped centering clip over the body of paddle 300. Centering pin 502 inserts into hole 112 in the top of grip 110 (as shown by dashed lines in FIG. 5A. When centering pin 502 is inserted into hole 112 of grip 110, grip 110 is stabilized and centered in slot 302 of paddle 300. Centering clip 500 may be similarly utilized in conjunction with other embodiments of the present invention as discussed below.

Figure 6:
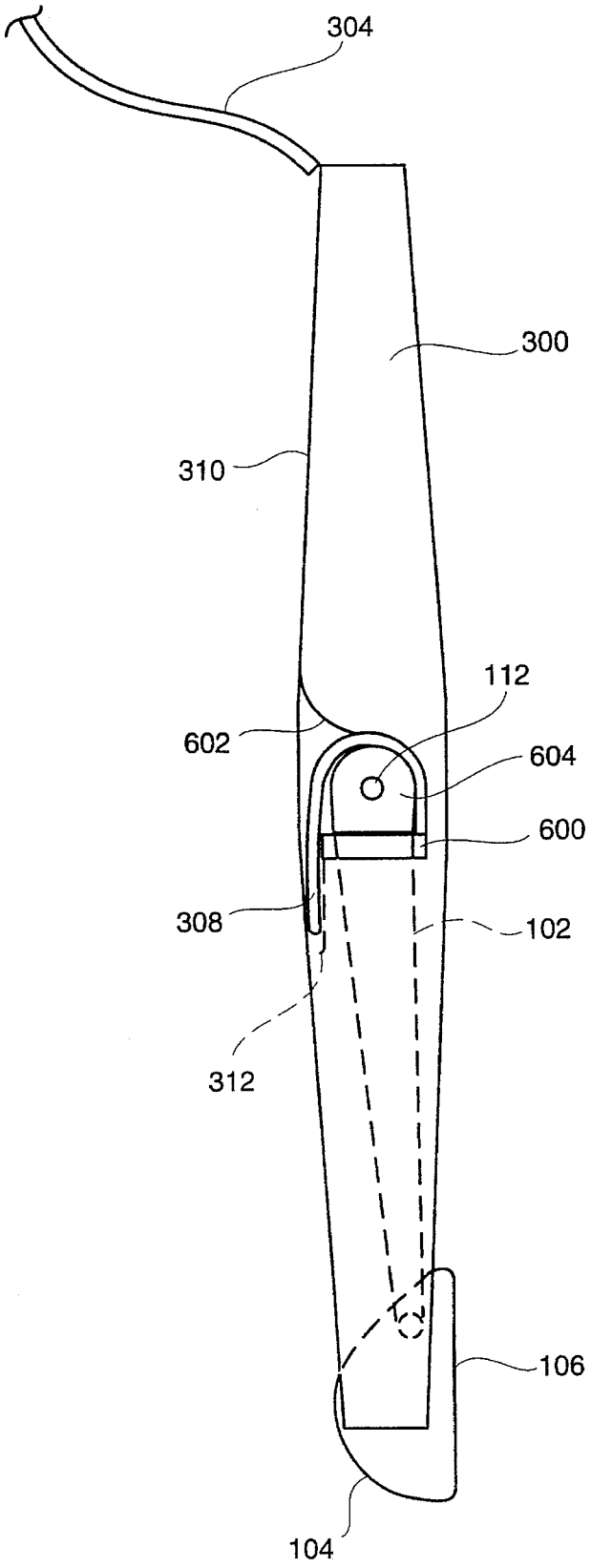
FIG. 6 shows a top view similar to that of FIG. 4 for another embodiment of the paddle of the present invention.

FIG. 6 shows a variant of the embodiment discussed above with respect to FIGS. 3–5. In FIG. 6, paddle 300 is shown with cover 304 open. Recess 312 is formed in paddle 300 to receive strap 308 when the strap is closed around grip 604. Grip 604 is common of many putter grips in that its front surface is flattened to permit a golfer to better maintain the alignment of the putter perpendicular to the intended path of the golf ball. Slot 602 in paddle 300 is adapted with a flat surface 600 padded with foam rubber to mate with the flattened surface of grip 604. The flattened surface of grip 604 is pressed against flattened 600 of slot 602 when straps 308 are closed around grip 604. The mated flattened surface 600 and grip 604 serve to aid in the positioning of paddle 300 in substantial parallel alignment with striking face 106 of putter head 104.

Securing the paddle to tile putter-spring biased split halves

Figure 7:
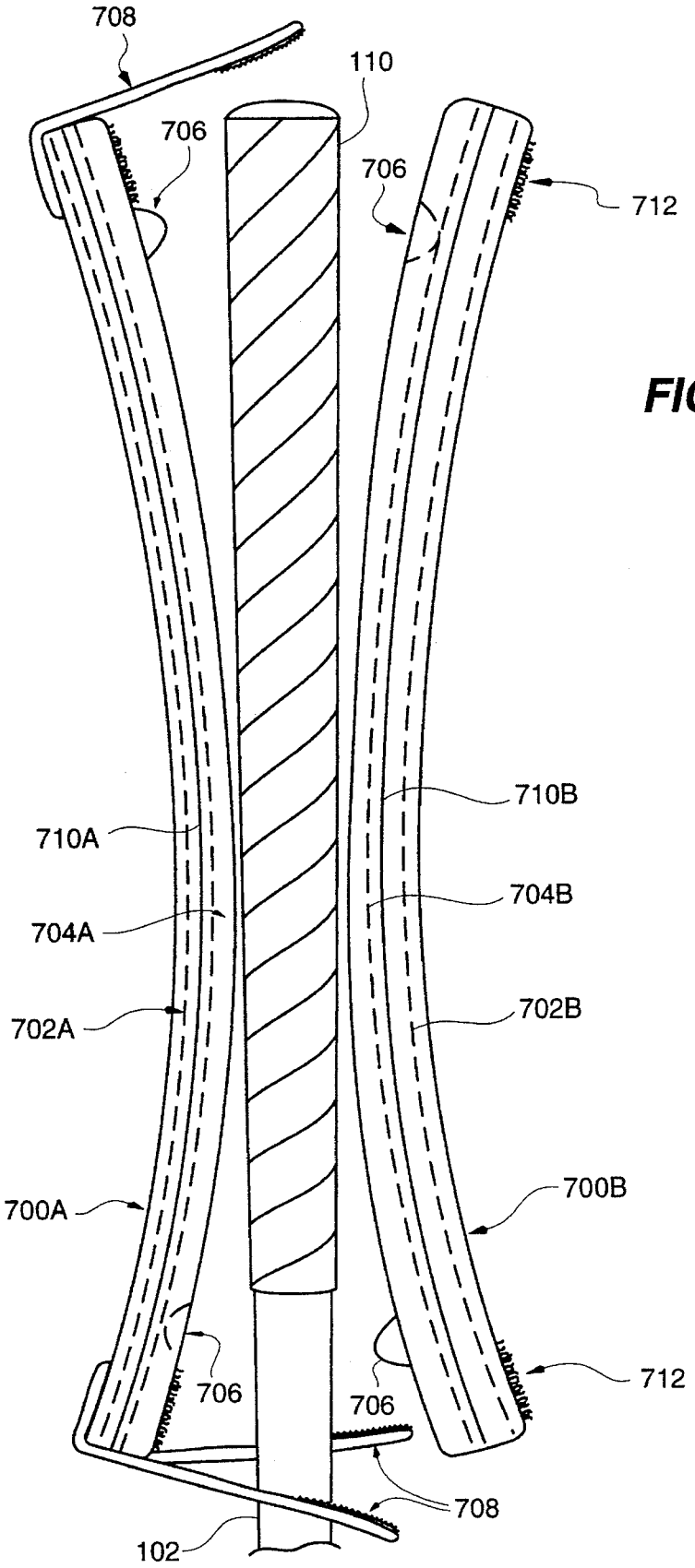
FIG. 7 is a front edge on view of another exemplary embodiment of the present invention.

FIG. 7 depicts a partial edge-on view of an alternative embodiment of the present invention. The embodiment of FIG. 7 is the best presently known mode of implementing the present invention due to its improved friction to secure the paddle to the putter grip and to maintain alignment of the paddle with the putter striking face. The paddle of FIG. 7 comprises two mated halves, 700A and 700B. Paddle halves 700A and 700B are comprised of and inner layers 704A and 704B laminated to corresponding outer layers 702A and 702B with a spring metal 710A and 710B therebetween. Spring metal 710A and 710B are normally curved to raise the top and bottom outward from the middle. Male and female positioning guides 706 are formed on the inner side of inner layers 704A and 704B. When two mated halves of the peddle are mated, male and female guides 706 are joined to align the two halves.

Figure 8:
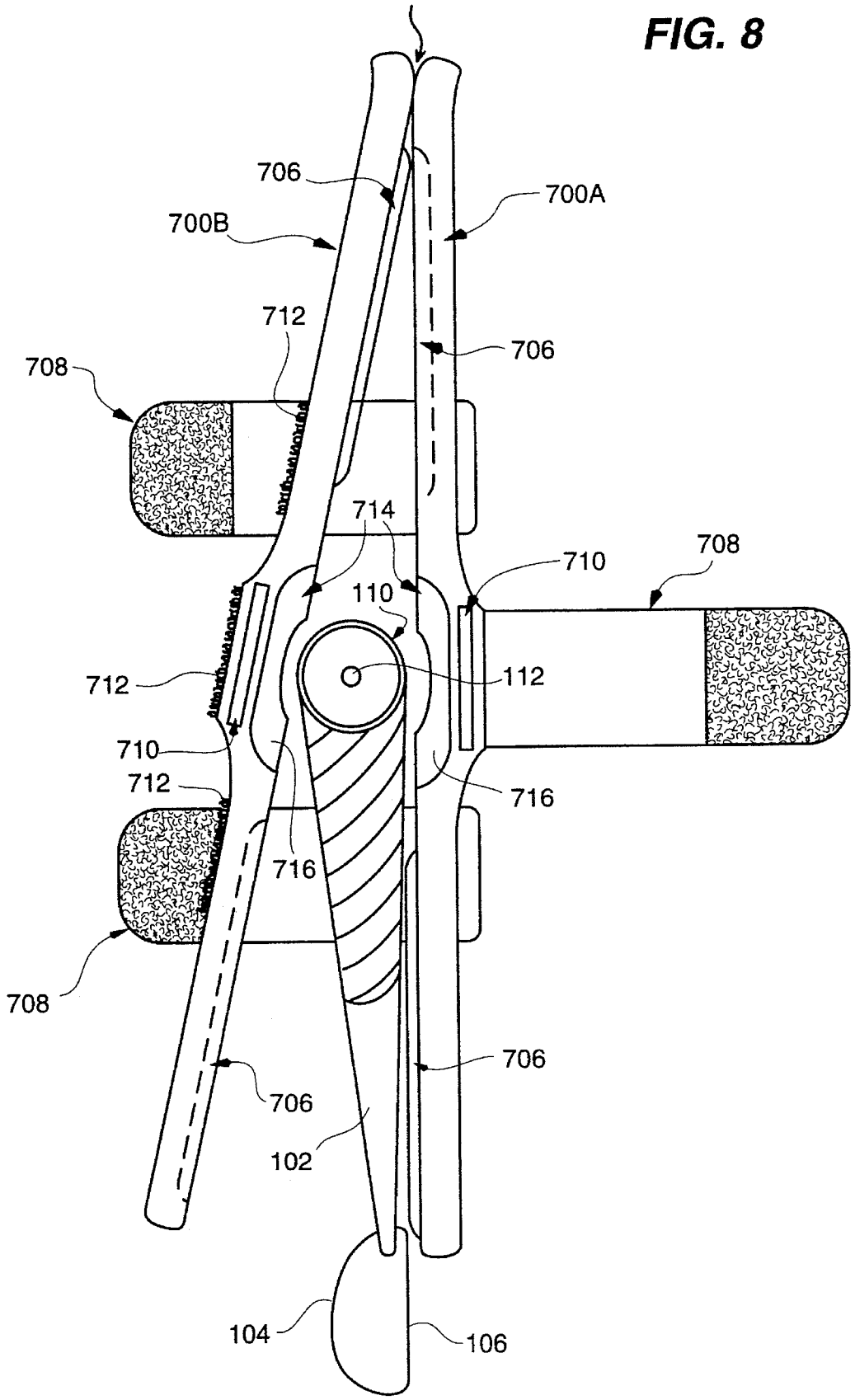
FIG. 8 is a top view of the exemplary embodiment shown in FIG. 7.

Both paddle halves. 700A and 700B, are shown from a top view in FIG. 8. Velcro straps 708 join and secure the two paddle halves 700A and 700B. Slots 716, lined with foam rubber 714, are formed in paddle halves 700A and 700B. Slots 716 receive and secure grip 110 between them when the two paddle halves 700A and 700B are joined When the Velcro straps 708 are closed at the top and bottom of the mated paddle halves and attached to corresponding Velcro pads 712, the paddle is secured to putter grip 110. The friction of foam rubber 714 in slots 716 against grip 110 secures the paddle to the grip and aids in maintaining the positioning of the paddle in substantial parallel alignment with putter striking face 106. Velcro straps 708 on paddle half 700A are attached to mated Velcro pads 712 on the opposing mated paddle half 700B.

There has been described a novel paddle grip for attachment to a golf putter which aids in teaching the golfer an improved putting stroke utilizing the upper body muscles in preference to the lower arm, wrist, and hand muscles. The paddle of the present invention is usable in a legal putting stance in which the golfer is positioned with his feet substantially parallel to the intended path of the putt. Various embodiments of the paddle have been disclosed varying in their particular style of attachment to the putter. It is evident, in view of the full disclosure of the paddle of the present invention, that those of ordinary skill in the art may now make numerous uses and modifications of the specific embodiment described herein without departing from the inventive concepts. For example, other methods of attaching the paddle to the putter may be utilized or the paddle may be permanently attached to the putter grip or shaft. Or, for example, other materials may be utilized to create the frictional forces which secure the paddle to the putter.

What is claimed:

1. A paddle grip attachable to a golf putter for training a golfer in the preferred method of putting a golf ball, said paddle grip comprising:

a paddle body having a first substantially flat planar surface and an opposed second substantially flat planar surface, wherein the first and second surfaces are in substantially parallel planes, and wherein the first and second planar surfaces each have a surface area sufficient to permit a golfer's palm and fingers to contact the surface when the golfer's palm is open and fingers are extended; and means for removably attaching said paddle body to the shaft of said putter, such that the plane of said first substantially planar surface is generally parallel to the plane of the face of the head of said putter, said attaching means including means for compressibly engaging the shaft of said putter.

2. The paddle grip of claim 1 wherein said means for removably attaching further comprises:

a slot in said paddle body having an inner surface adapted to receive the grip of said putter; and a lining in said slot adapted to provide a high coefficient of friction between said inner surface of said slot and said grip.

3. The paddle grip of claim 2 wherein said lining comprises a foam rubber material.

4. The paddle grip of claim 2 further comprising strap means, attached to said paddle body, for pressing said grip against said lining of said slot.

5. The paddle grip of claim 1 wherein said paddle body further comprises:

a first portion comprising said first substantially planar surface; and a second portion, separable from said first portion, comprising said second substantially planar surface.

6. The paddle grip of claim 5 further comprising:

gender specific mating means in said first portion adapted to mate with gender specific mating means in said second portion; and gender specific mating means in said second portion adapted to mate with gender specific mating means in said first portion to assure alignment of said first portion with said second portion.

7. The paddle grip of claim 5 wherein said means for removably attaching further comprises:

a first slot in said first portion having an inner surface adapted to receive the grip of said putter;

a second slot in sale second portion having an inner surface to receive the grip of said putter, wherein said first slot and said second slot are adapted to align to jointly receive said grip when said first portion is mated to said second portion; and a lining in said first slot and in said second slot adapted to provide a high coefficient of friction between said inner surface of said first slot and said grip and between the inner surface of said second slot and said grip.

8. The paddle grip of claim 7 wherein said lining comprises a foam rubber material.

* * * * *